US005430905A

United States Patent [19]

Curtin

[11] Patent Number: 5,430,905

[45] Date of Patent: Jul. 11, 1995

[54] SCULPTURING AND PRIMING BRUSH

[76] Inventor: Marcia A. Curtin, 76 Angle Rd., West Seneca, N.Y. 14224

[21] Appl. No.: 288,829

[22] Filed: Aug. 11, 1994

[51] Int. Cl.[6] ..... A46B 9/04; A46B 17/02; A46B 15/00

[52] U.S. Cl. ..... 15/106; 15/167.3; 15/160; D4/119; D4/106; 132/73.5

[58] Field of Search ..... 15/106, 105, 207.2, 15/160, 167.1, 167.3; D4/130, 119, 120, 105; 132/320, 73.5, 73

[56] References Cited

U.S. PATENT DOCUMENTS

| | | | |
|---|---|---|---|
| D. 279,729 | 7/1985 | Polanish | D4/135 |
| D. 297,889 | 10/1988 | Ries et al. | D4/135 |
| D. 306,493 | 3/1990 | Pessis | D28/7 |
| 2,251,853 | 8/1941 | Pandiyan | 15/106 |
| 2,803,029 | 8/1957 | Brady | 15/106 |
| 2,816,305 | 12/1957 | Kravitt | 15/106 |
| 2,887,340 | 5/1959 | Veneko | 15/207.2 |
| 3,924,287 | 12/1975 | Brown | 15/159.1 |
| 4,025,982 | 5/1977 | Palmer | 15/106 |
| 5,150,495 | 9/1992 | Discko, Jr. et al. | 15/106 |
| 5,220,702 | 6/1993 | Howell et al. | 15/207.2 |

FOREIGN PATENT DOCUMENTS

| | | | |
|---|---|---|---|
| 890205 | 2/1944 | France | 15/167.3 |
| 926363 | 4/1955 | Germany | 15/106 |

*Primary Examiner*—Gary K. Graham
*Attorney, Agent, or Firm*—James J. Ralabate

[57] ABSTRACT

A brush used for sculpturing artificial nails has a brush or bristles on each end. One of the brushes is a priming brush and the other brush is a sculpturing brush. The priming brush does not exceed 1.800 mm at its base section and the sculpturing brushes are always substantially wider at their base sections than the priming brush.

7 Claims, 1 Drawing Sheet

SCULPTURING AND PRIMING BRUSH

This invention relates to a sculpturing brush used for applying materials to a human fingernail and, more specifically, to a novel brush structure that simplifies the sculpturing process.

BACKGROUND OF THE INVENTION

When a technician sculptures a nail several factors determine the quality of the final product. Obviously, the skill of the technician is very relevant as is the material used and the brushes used to apply these materials. The nail must first be primed in order to prepare the nail for the polymeric compound to be later applied. The primer also acts as an oil dehydrator and germicide in addition to etching the nail surface for enhanced adhesion properties. Most nail products used in sculpturing an artificial nail onto the natural nail surface are acrylic-based polymers. The most commonly used sculpturing material is polyethylmethacrylate (PEMA). Generally, the PEMA is in the form of a powder which will become the carrier for a mixing liquid, usually ethylmethacrylate (EMA) so that the mixture PEMA-EMA when applied to the fingernail will be a dough-like substance and will not easily run off the nail. As earlier noted, however, priming of the nail is important to the overall sculpturing procedure. The sculpturing product is used after the nail is primed with methacrylic acid. The sculpturing product is a fine-grit powder (PEMA) that undergoes a visible physical change when mixed with a liquid solution, usually EMA. The powder dissolves and, in proper consistencies, takes on the appearance of melted wax. Using a brush the technician applies this mixture to a form and atop the natural nail, carefully sculpting it. As the physical change continues, the mixture hardens or "cures". Once cured, the product can be further shaped by sanding it into a natural-looking, durable nail.

As the sculptured nail industry grows, more manufacturers are making products related to the process. There are literally dozens of sculpturing products available to the professional nail technician. It is therefore important to shop wisely. As wide as the variety of labels is, there is also a broad range of qualities to choose from—some excellent, some poor.

Also as indicated above, the tools used, especially the application brushes are vital to a successful final product, i.e. sculptured nail. Presently, the nail technician uses two separate brushes in this procedure. The first is a priming brush used to apply a primer solution to the nail. The primer being an acid liquid such as methacrylic acid can be highly corrosive and toxic to the skin. If the wrong primer brush is used or a brush that is too large, primer material can contact and burn the flesh around the nail. To avoid or minimize this, very small and somewhat fine bristle brushes have been used. When the priming step is completed, the priming brush is left unused and the sculpturing brush is quickly picked up to complete the sculpturing process. In the meantime, the priming brush is placed on a counter or paper or other suppor6t where extraneous debris may be picked up or the material on the brush can harden. Unless cleaned timely, each of the two brushes, the priming and the sculpturing brush, can be damaged because of the adhering materials which will not only shorten the brush life but reduce its effectiveness for the next usage. Even if the technician has purchased the best quality brushes, improper care can and often does shorten their effective life. Many acrylic manufacturers provide a brush cleaner that should be used with their product lines but even when following their specific instructions, the brushes are easily damaged because of the hiatus in use. Most chemical cleaners are harsh on the natural hair bristles and the bristles should never be soaked for any extended period of time. There is, therefore, a need for a brush product that will substantially reduce the time between the priming step and the sculpturing step thereby substantially prolonging the brush's useful life.

Most brushes used by the professional have sable bristles on one end varying in size and shape. A separate, very small priming brush is used to apply the methacrylic acid solution. This brush is purposely small so that the acid solution does not touch the flesh surrounding the nail being treated. As noted earlier, this methacrylic acid solution is highly corrosive to the skin and eyes. Several different size quality brushes used to sculpture nails can be obtained from OPI Products Inc. of North Hollywood, Calif. 91605. Other sources of such brushes are also available to the professional. The sculpturing and priming brush is generally divided into three parts:

(1) the top
(2) the barrel; and
(3) the base

The barrel is the fullest part of the brush and is located in the center between the base and the top. The barrel generally acts as a reservoir where the liquid is held or stored during use. The brush is usually dipped into the liquid all the way to the base and wiped off against the container holding the liquid to get rid of excess liquid. The reservoir or barrel holding the liquid now is able to pick up the powder product to be mixed therewith. When applying the liquid-powder mixture to the nail, it is important that the nail be properly primed before said application. As noted earlier, the shorter the time lapse between steps is important so that the brush will not harden because the cleaning was delayed.

In addition to the above-mentioned OPI brushes, several different brush applicators have been described in U.S. and foreign patents. Some brushes are defined in U.S. Pat. Nos. Des. 279,729; Des. 297,889; Des. 306,493; 5,150,495 and German Patent 926,363.

In U.S. Pat. No. Des. 279,729 (Polanish) a flat brush is illustrated having bristles on one side, said bristles being relatively coarse and flat. In U.S. Pat. No. Des. 297,889 (Ries et al.) a fingernail striping brush used solely for striping artwork on the finished nail is illustrated having approximately twelve untapered bristles which form the brush. Again, the bristles are only on one end of the brush. U.S. Pat. No. Des. 306,493 (Pessis) illustrates a tapered bristle brush used to apply compositions to a nail. Here again, the bristles are on only one side of the brush and are apparently used for the sculpturing rather than the priming step. In U.S. Pat. No. 5,150,495 (Discko, Jr. et al.) a disposable dental brush is disclosed which has a reusable handle with disposable brush tips on either side. This brush, while functional for dental usage, would not be suitable for sculpturing since the bristles or brush are too large for the priming step. Also, being expendable, the brushes most likely are not of high enough quality to be usable in sculpturing. Also, because of the equal size and shape of the bristles illustrated, the reservoir in the barrel necessary to hold liquid before powder touching is absent. A suitable structured brush with appropriate bristles of different sizes on each end is needed for the specific nail sculpturing process. The same can be said for the two-sided brush disclosed in German Patent 926,363 which can be only used in hair painting. Again, the bristles appear to be of equal size and totally unsuitable for nail sculpturing, especially for the primer step.

SUMMARY OF THE INVENTION

It is therefore an object of this invention to provide a two-brush sculpturing tool devoid of the above-noted disadvantages.

Another object of this invention is to provide a sculpturing tool having brush bristles on both ends each of different sizes adapted for the total sculpturing process.

Still another object of this invention is to provide a sculpturing tool that can be easily cleaned and where hardening of the bristles is kept to a minimum.

Yet another object of this invention is to provide a sculpturing tool which reduces the inventory of brushes or tools required for the sculpturing process.

Still a further object of this invention is to provide a sculpturing tool specifically designed for sculpturing and usable without the need for further brushes or applicators.

A further object of this invention is to provide a sculpturing applicator that is time saving, easy to use, easy to clean and reduces the costs associated with this process.

These and further objects are accomplished, generally speaking, by providing a sculpturing tool, brush or applicator having definite different size bristles on each end. The base portion of the brushes is defined as the bristle section closest to the handle, above the barrel and tip sections. It is critical to the present invention that the dimension of the width of the sculpturing brush (its base portion) be from about 2.616 mm to about 6.35 mm. That would be equal to width dimensions of about 0.100 inches to about 0.300 inches. The priming brush on the other end of the brush handle must not exceed about 0.07 inches wide or about 1.8 mm wide. For best results it is preferred that the width of the primer brush base be about 0.053 inches or 1.346 mm. While the width of the sculpturing brush base will vary depending upon the brush size desired for the sculpturing process, the base width size of the primer must never exceed about 0.07 inches or about 1.8 mm. Beyond that size proper acid application cannot be controlled in the priming step and damage or burning of flesh adjacent the nail will likely occur. Therefore, the sculpturing end of the brush will have dimensions of about 0.100 inches to about 0.300 inches or about 2.600 mm to about 7.00 mm.

The brushes on either end may be permanently attached or may be removable as desired. It is preferred that, for best results, sable bristles be used but any suitable brush bristle may be used.

DETAILED DESCRIPTION OF DRAWINGS AND PREFERRED EMBODIMENTS

Figure 1:
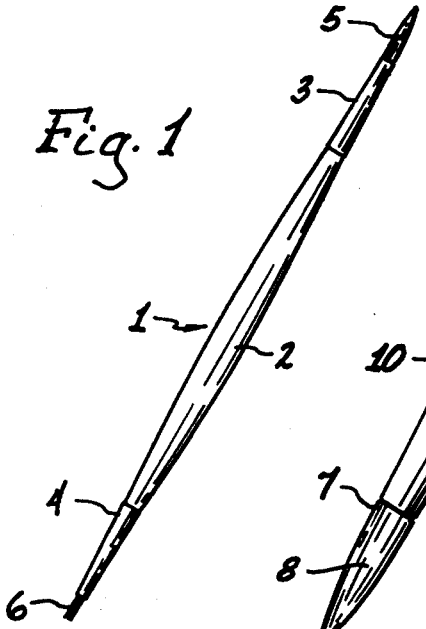
FIG. 1 is a plan view of the two-sided nail sculpturing brush of this invention.

In FIG. 1 a two-sided brush tool 1 is illustrated having a handle 2 tapered at each end, sculpturing end 3 and priming end 4. At end 3 is positioned a sable or other suitable bristle brush 5 that is used for sculpturing or applying the PEMA and EMA to the nail after priming. At end 4 is positioned a sable or other suitable bristle brush 6 that is used for priming or applying the methacrylic acid to the nail to etch it prior to applying the PEMA-EMA mixture. The measure of the priming brush at its base section should never exvceed about 0.07 inches wide or about 1.8 mm or from about 0.5 mm to about 1.8 mm. The brush 5 measured at its base section can vary from 0.10 inches to about 0.30 inches or about 2.60 mm to about 7.00 mm. Round, oval or flat bristles size numbers 4–12 obtainable from OPI above noted may be used at 5. OPI also identifies their brushes as OPI.922 to OPI.928. It is important for proper balance of handle 2 that it be tapered at its end portions 3 and 4 and to accommodate the smaller width attached brushes 5 and 6.

Figure 2:
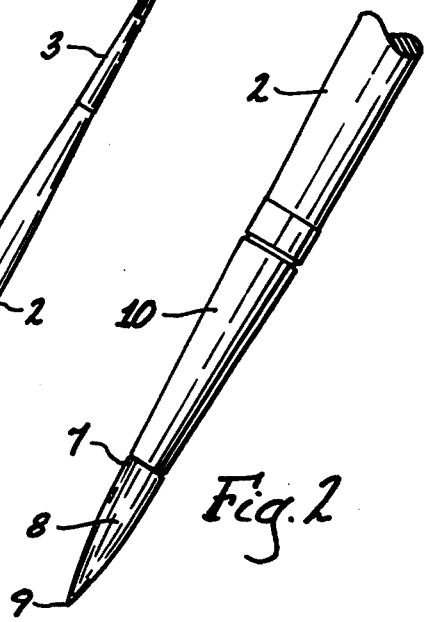
FIG. 2 is a plan view of the three sections of a sculpturing nail brush.

In FIG. 2 a typical brush used for sculpturing a nail is illustrated. The brush bristles have a base section 7 which is closest to handle 2. Next is the barrel section 8 which acts as the reservoir for the PEMA-EMA mixture and at the end is a point section 9 which contacts the nail during the sculpturing operation or process. The bristles are held onto handle 2 by metal or plastic binders 10 which are substantially unreactive with any of the chemicals used in sculpturing.

Figure 3:
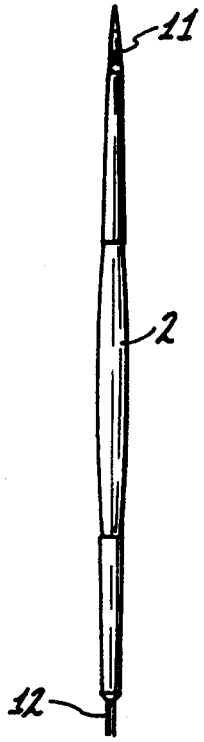
FIGS. 3–9 illustrate different sizes for the brushes of this invention.

In FIG. 3 a petite fine point brush 11 is used as the sculpturing brush. It has a base dimension of about 2.616 mm and is ideal for fine detail work. Note that, as fine as brush 11 is, it nevertheless is larger than the priming brush 12 at the other end. Priming brush 12 has a base width dimension of about 1.346 mm.

Figure 4:
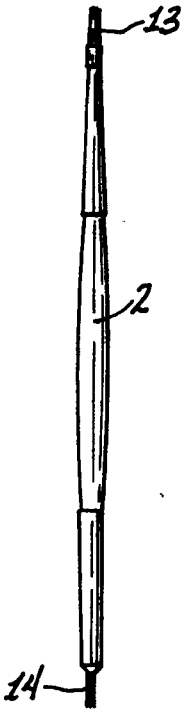

In FIG. 4 a flat edge petite brush 13 is illustrated. The flat edge delivers high accuracy for detail work. The base width dimension of brush 13 is about 3.759 mm. The base width dimension of priming brush 14 on the other end of handle 2 is 1.346 mm.

Figure 5:
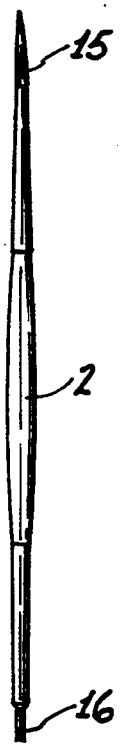

In FIG. 5 a medium point round brush 15 can be used to achieve a sculptured nail that has a natural look. The dimension of the base of brush 15 is 3.810 mm, the dimension of the base of primer brush 16 is 1.502 mm.

Figure 6:
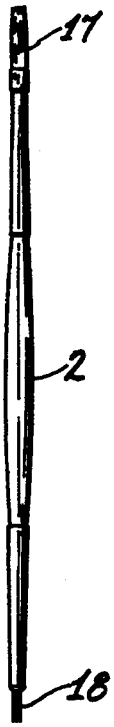

In FIG. 6 a flat shape sculpturing brush 17 is illustrated. This brush 17 is adapted for the "patting" application technique and has a dense concentration of bristles. Also, this type brush will hold in its barrel or reservoir a relatively substantial amount of material. The priming brush 18 at the opposite end has a base width measurement of 1.611 mm.

Figure 7:
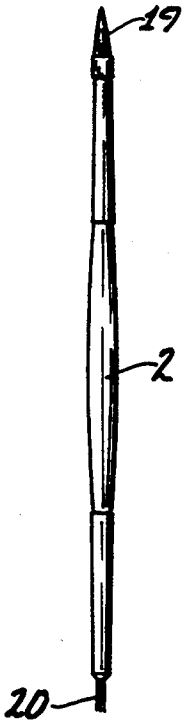

In FIG. 7 an oval brush 19 is illustrated. This type brush 19 is naturally contoured to the shape of a cuticle and allows fast application of the PEMA-EMA mixture by the very experienced nail technician. The base section of brush 19 measures 5.715 mm while the opposite end priming brush 20 measures at its base 1.690 mm.

Figure 8:
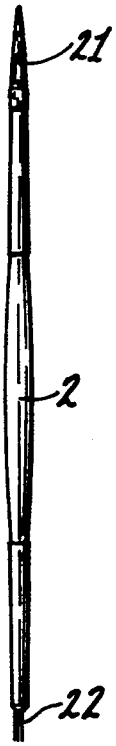

In FIG. 8 a wider brush 21 with a flatter barrel is shown which is important for holding large quantities of PEMA-EMA mixtures. Brush 21 measures 5.842 mm while opposite end primer brush measures at its base portion 1.710 mm.

Figure 9:
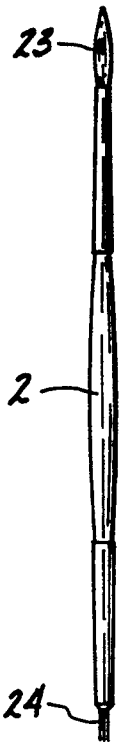

In FIG. 9 a larger brush 23 is illustrated. This type brush is used generally by the expert technician who has complete control and wants the greatest surface area to work with. It holds the largest amount (of the brushes illustrated herein) of material in its barrel and maintains its rounded silhouette throughout the length of the bristles. This brush 23 measures 6.5 to about 7.0 mm at its base sectionh; priming brush 24 at the opposite end of handle 2 measures 1.800 mm. It is vital to the present invention that the priming brushes 12, 14, 16, 18, 20, 22 and 24 not exceed about 1.800 mm for the reasons earlier stated. Also, sculpturing brushes 11, 13, 15, 17, 19, 21 and 23 should not go much beyond about 7.0 mm since it will not allow proper control of the PEMA-EMA mixture and will be too large for average nail application.

The preferred and optimumly preferred embodiments of the present invention have been described herein and shown in the accompanying drawings to illustrate the underlying principles of the invention but it is to be understood that numerous modifications and ramifications may be made without departing from the spirit and scope of this invention.

What is claimed is:

1. A nail-sculpturing tool comprising an elongated handle having two terminal ends and two brushes, said handle tapered tapers to both its terminal ends to define a sculpturing and priming end, one of said brushes is a sculpturing brush which is attached to and extends longitudinally from said at a sculpturing end of said handle and a second of said brushes is a priming brush which is attached to and extends longitudinally from said priming end of said handle, each said brush having a base section, a barrel section and a point section, said base section of each brush located immediately adjacent said terminal ends of said handle, said priming brush located at said priming end of said handle having a width at its base section not exceeding about 1.800 mm and wherein said sculpturing brush located at said sculpturing end of said handle has a width at its base section lying in the range of from about 2,600 mm to about 7.000 mm.

2. The tool of claim 1 wherein said handle is tapered at each of its terminal ends and has a large diameter at a center handle portion.

3. The tool of claim 1 wherein the width of said priming brush at the base section is about 1.350 mm.

4. The tool of claim 1 wherein said sculpturing brush width is substantially larger than said priming brush width as measured at their base sections.

5. The tool of claim 1 wherein both of said sculpturing and said priming brushes comprise sable.

6. The tool of claim 1 wherein the width of said sculpturing brush does not exceed about 7.000 mm at its base section.

7. The tool of claim 1 wherein the width of said sculpturing brush at its base section lies in the range of about 2.600 mm to about 7.000 mm and wherein the width of said priming brush at its base section is about 1.400 mm.

* * * * *